US007591085B2

(12) United States Patent
Haugltn

(10) Patent No.: US 7,591,085 B2
(45) **Date of Patent: *Sep. 22, 2009**

(54) OUTSOLE FOR A SPORTS SHOE, ESPECIALLY A CROSS-COUNTRY SKI BOOT OR TELEMARK BOOT

(75) Inventor: Bernt-Otto Haugltn, Royken (NO)

(73) Assignee: Rottefella AS, Klokkarstua (NO)

( * ) Notice: Subject to any disclaimer, the term of this patent is extended or adjusted under 35 U.S.C. 154(b) by 636 days.

This patent is subject to a terminal disclaimer.

(21) Appl. No.: 11/034,454

(22) Filed: Jan. 11, 2005

(65) Prior Publication Data

US 2005/0178024 A1 Aug. 18, 2005

(30) Foreign Application Priority Data

Jan. 28, 2004 (DE) ..... 10 2004 004 317

(51) Int. Cl.
*A43B 5/04* (2006.01)

(52) U.S. Cl. ..... 36/117.3; 36/102; 36/117.1

(58) Field of Classification Search ..... 36/102, 36/25 R, 117.2, 117.3
See application file for complete search history.

(56) References Cited

U.S. PATENT DOCUMENTS

| | | | | |
|---|---|---|---|---|
| 4,186,500 A | | 2/1980 | Salzman | |
| 4,571,858 A | * | 2/1986 | Faulin | 36/117.4 |
| D345,454 S | * | 3/1994 | Hauglin | D2/957 |
| 5,899,006 A | * | 5/1999 | Donnadieu | 36/97 |
| 6,216,366 B1 | | 4/2001 | Donnadieu | |
| 6,289,610 B1 | * | 9/2001 | Girard et al. | 36/117.2 |
| 6,374,517 B2 | * | 4/2002 | Girard et al. | 36/117.3 |
| D488,294 S | * | 4/2004 | Lancon | D2/957 |
| 2008/0127523 A1 | * | 6/2008 | Hauglin | 36/117.2 |

FOREIGN PATENT DOCUMENTS

| | | |
|---|---|---|
| CH | 557 154 | 12/1974 |
| DE | 26 45 007 | 10/1976 |
| DE | 26 45 007 A1 | 4/1978 |
| DE | 31 13 942 A1 | 10/1982 |
| DE | 3113942 | 10/1982 |
| DE | 3113942 A1 | 10/1982 |
| DE | 37 85 420 T2 | 6/1987 |
| DE | 42 290 39 C2 | 9/1992 |
| EP | 0 029 206 A1 | 5/1981 |
| EP | 0 787 440 B1 | 8/1997 |
| FR | 2 556 188 A1 | 12/1983 |
| NO | 319592 | 7/2003 |

* cited by examiner

*Primary Examiner*—Jila M Mohandesi
(74) *Attorney, Agent, or Firm*—Knobbe Martens Olson & Bear LLP

(57) ABSTRACT

Outsole for a sports shoe, having a rear portion, which has a shoe heel, and a front portion, which is of slightly dish-shaped configuration, the outsole being produced so as to be continuously of relatively hard material, and being provided on the tread side, both in the region of the front portion and in the region of the rear portion, with a tread layer of relatively soft, material.

13 Claims, 3 Drawing Sheets

OUTSOLE FOR A SPORTS SHOE, ESPECIALLY A CROSS-COUNTRY SKI BOOT OR TELEMARK BOOT

BACKGROUND

1. Field

The present invention relates to an outsole for a sports shoe, especially a cross-country ski boot or telemark boot, consisting of a rear portion, which comprises a shoe heel, and a front portion, which is of slightly dish-shaped configuration, the outsole being produced so as to be continuously of relatively hard material, especially plastics, and being provided on the tread side, both in the region of the front portion and in the region of the rear portion, with a tread layer of relatively soft, especially rubber-like, material, which together with the associated outsole portions defines a predetermined overall sole thickness or sole height.

2. Description of Related Art

Outsoles of such a kind are generally known. For example, they have been manufactured and sold by the Applicant under the Trade Mark "NNN" for years. Those outsoles have, on the tread side, two longitudinal guidance grooves and also transverse grooves which are connected thereto, the longitudinal guidance grooves extending over the entire length of the sole and co-operating with complementary longitudinal guidance ribs on an associated ski-binding plate. At the front end of the sole, on the tread side, there is provided within a recess provided on the tread side a transverse pin for articulated connection to a ski binding, the articulation being such that the shoe heel can be lifted up freely.

On the side of the upper, the outsole is provided with longitudinal and transverse ribs which bound corresponding recesses with the result that maximum stability, especially torsional stability, is obtained with a minimal use of material. The afore-mentioned longitudinal guidance grooves are formed not only within the tread layer but also within the outsole itself. As a result, the bending elasticity is considerably impaired, especially in the metatarsophalangeal region of the outsole. In order to solve that problem, EP 0 787 440 B1 proposes that the outsole of a sports shoe be produced from two parts, the rear part being of rigid construction and the front part being made from a soft material. A disadvantage of such an arrangement, however, is that the sole cannot be produced so as to be continuously of one and the same material, for example by means of injection-moulding. The cost of sole manufacture is therefore disproportionately high, with EP 0 787 440 B1 also proposing in that regard that the front and rear parts each be joined to the other with an overlap.

The present invention is accordingly based on the problem of so developing an outsole of the kind mentioned at the beginning that, by simple manufacturing means, a sole having maximum bending elasticity in the metatarsophalangeal region is obtained without the lateral, especially torsional, stability of the sole and of the upper connected thereto being lost as a result of the chosen construction.

SUMMARY

One aspect of the present invention accordingly lies in the fact that at least the front portion of the outsole has no grooves or ribs which counteract the flexibility at least in the region of the so-called metatarsophalangeal zone and, more specifically, especially about the so-called metatarsophalangeal bending axis. In that connection, it should be mentioned that, strictly speaking, the metatarsophalangeal bending axis is not defined by a line but rather by a strip-shaped zone that extends in a direction transverse to the longitudinal direction of the sole and, more specifically, inclined at an angle to the longitudinal direction of the sole from the inside at the front to the outside at the rear.

The afore-mentioned aim of the invention is achieved, in specific terms, by means of the fact that the front portion of the outsole is of substantially continuously smooth construction at least on the side of the upper, and especially both on the side of the upper and on the tread side, and, whilst having an unchanging predetermined overall thickness, has at least in the region of the so-called metatarsophalangeal zone a considerably reduced thickness that corresponds to at most about 50%, especially 30-35%, of the overall thickness of hard and soft material.

Preferably, the outsole consists of a plastics material having a modulus of elasticity of between 200 MPa and 250 GPa, especially between 350 MPa and 200 GPa, the modulus of elasticity governing the thickness in the front portion in such a manner that, in percentage terms, the thickness is greater in the case of relatively high elasticity than in the case of relatively low elasticity. This means that the more rigid the sole material, the thinner the basic sole has to be, at least in the metatarsophalangeal region, with the softer tread layer being correspondingly thicker.

The outsole according to the invention is also preferably to be formed, on the tread side, with at least one longitudinal guidance groove and, at least in the region of the metatarsophalangeal zone, with one or more transverse grooves, those grooves, at least in the front portion of the outsole, being formed substantially only within the tread layer of softer material. The front sole portion, which is made from harder material, accordingly constitutes a thin-walled dish which is substantially smooth on both the inside and the outside. The afore-mentioned dish configuration ensures the requisite rigidity, especially torsional rigidity, of the outsole.

One embodiment in which the transverse grooves are, at least in the front portion, each curved in a backwards direction, increases the stability of the sole, especially the torsional stability, with the flexibility remaining unchanged.

In another embodiment there are integrated into the lateral boundary of the recess at the front end of the sole, for the purpose of accommodating a transverse pin, anchoring elements, especially of metal, which are connected thereto. Those anchoring elements are necessary especially when the transverse pin is to be anchored in the relatively soft tread layer. To accommodate the transverse pin it is, of course, also feasible, in conventional manner, for the recess at the front end of the sole to be bounded by two side cheeks of hard sole material which are integrally joined to the outsole.

The tread layer may be either welded or bonded to the outsole on the tread side.

Finally, it should be mentioned that, whilst the predetermined overall thickness is unchanging, the thickness of the front portion of the outsole, which outsole is made from harder material, continuously increases at least in the direction towards the rear, starting from the metatarsophalangeal bending zone. The rear portion, especially the heel of the outsole, is preferably of conventional construction, that is to say is provided on the upper's side with material-reducing and weight-reducing recesses.

BRIEF DESCRIPTION OF THE DRAWINGS

A preferred embodiment of an outsole according to the invention will be explained hereinbelow in greater detail with reference to the accompanying drawings, in which.

DETAILED DESCRIPTION

Figure 1:
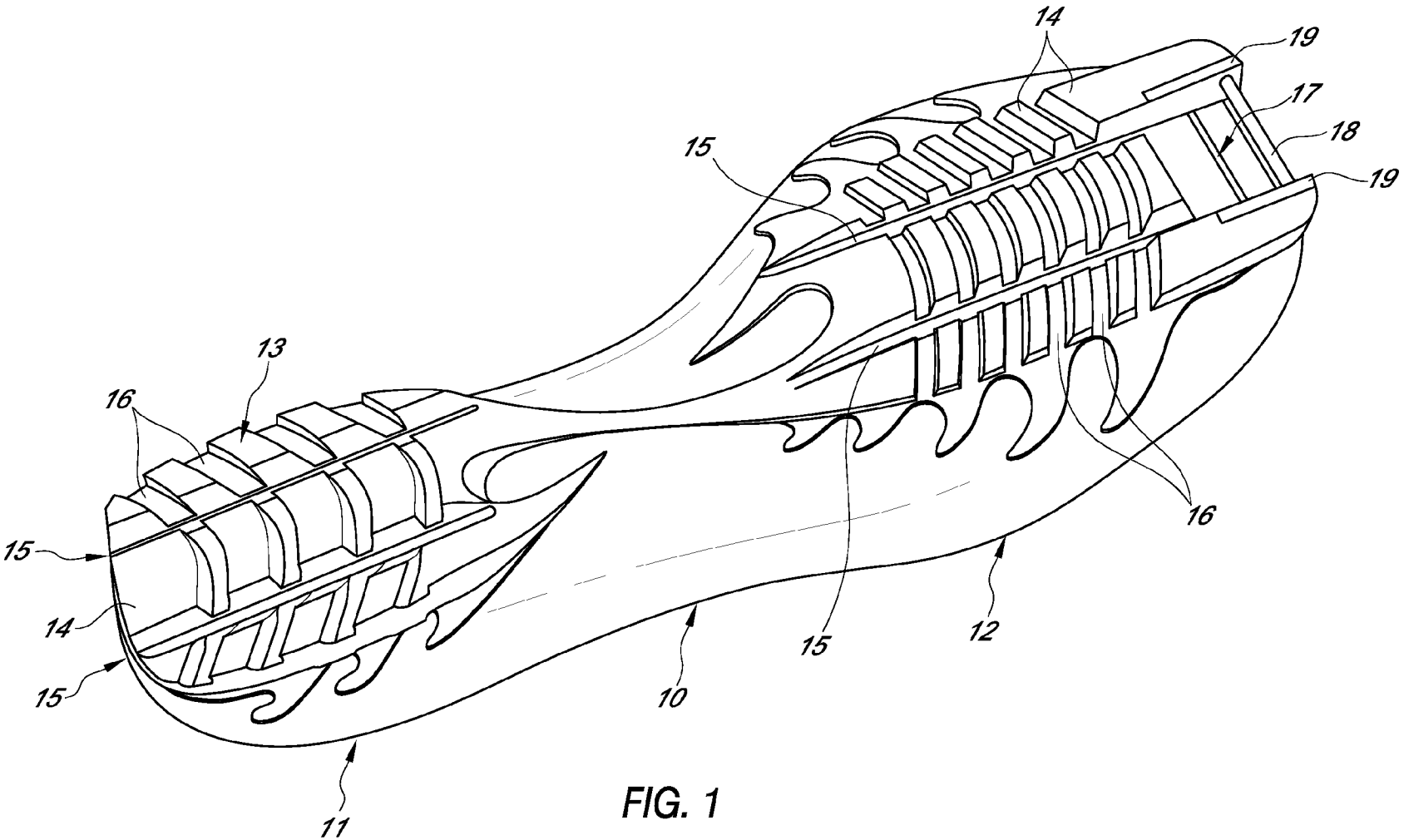
FIG. 1 is a perspective view from below of an outsole formed in accordance with the invention.
Figure 2:
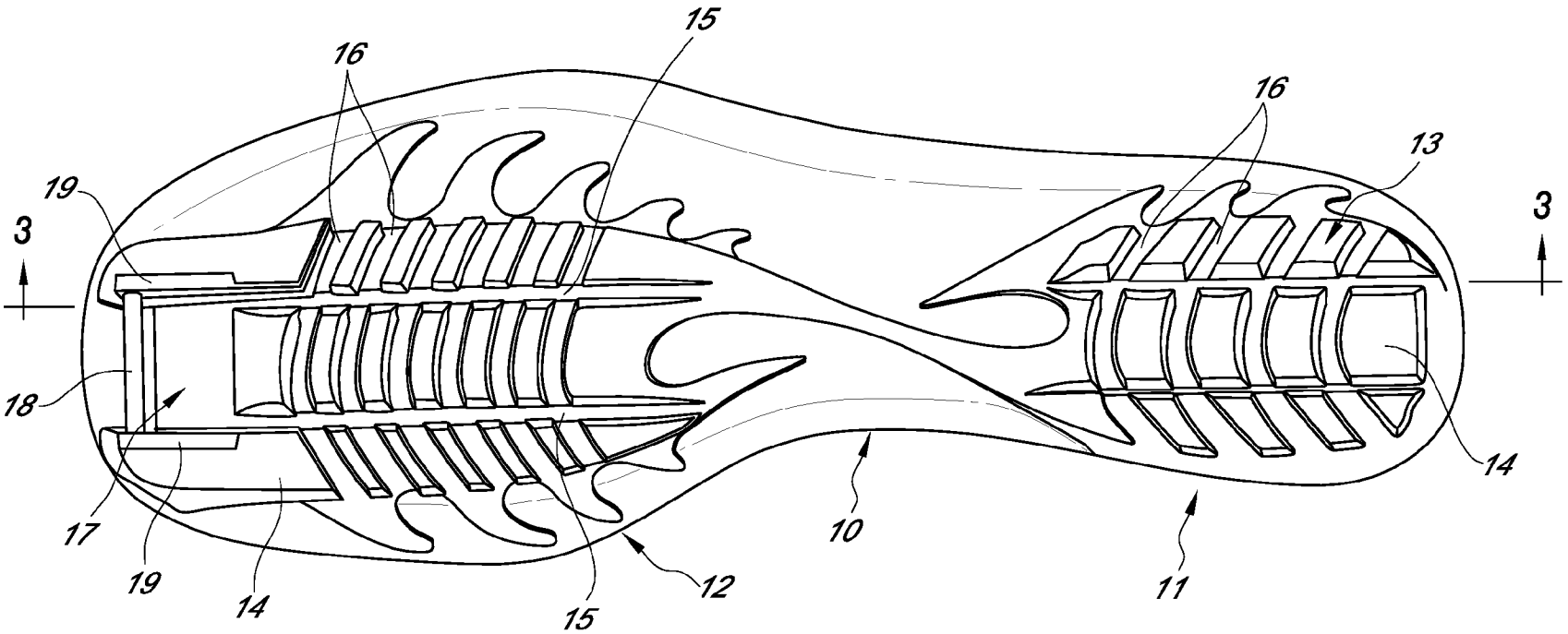
FIG. 2 is a plan view of the outsole according to FIG. 1 to an enlarged scale.
Figure 3:
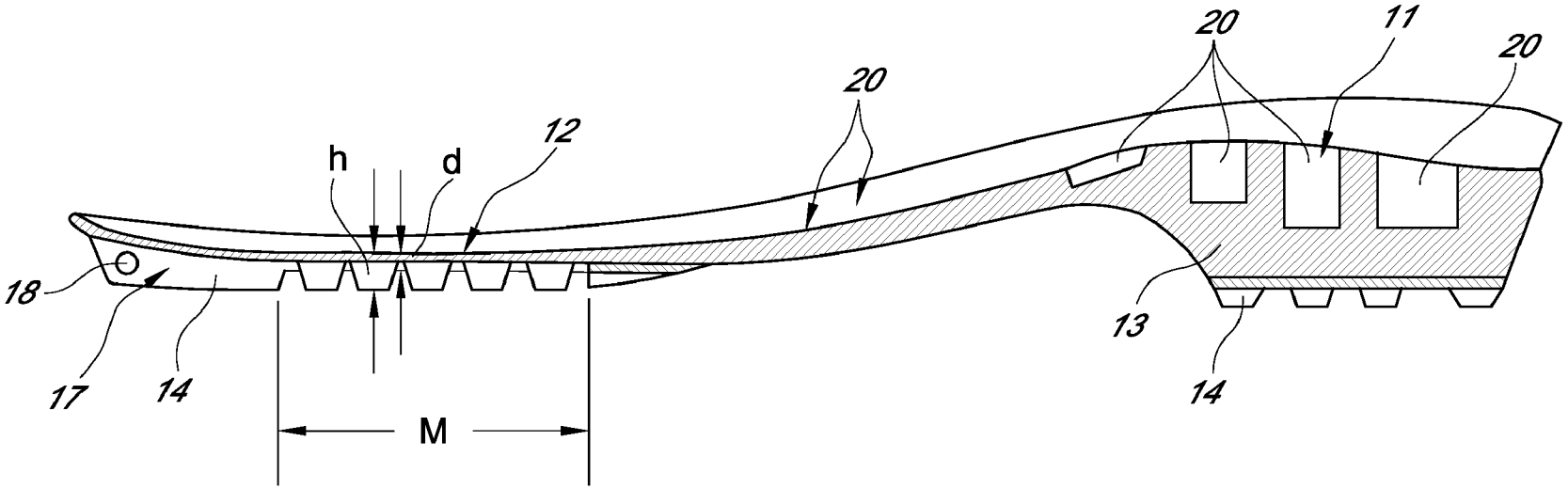
FIG. 3 is a longitudinal section through the outsole according to FIGS. 1 and 2, along line III-III in FIG. 2, to a reduced scale.

FIGS. 1 and 2 each show from below an outsole 10 for a cross-country ski boot. This outsole consists of a rear portion 11, which comprises a shoe heel 13, and a front portion 12, which is of slightly dish-shaped configuration, that is to say shallow dish-shaped configuration, the outsole 10 being produced so as to be continuously of a relatively hard material, especially plastics, and being provided on the tread side, both in the region of the front portion and in the region of the rear portion, with a tread layer 14 of relatively soft, especially rubber-like, material. Together with the associated outsole portions 11 and 12, the tread layer 14 defines a predetermined overall sole thickness or sole height "h", as shown in FIG. 3 in the region of a so-called metatarsophalangeal bending zone "M". The front portion 12 of the outsole 10 is of substantially continuously smooth construction at least on the side of the upper—and, in the case of the exemplary embodiment shown, on the tread side too. Furthermore, the front portion 12 of the outsole 10, whilst having an unchanging predetermined overall thickness "h" of hard and soft material, has at least in the region of the metatarsophalangeal zone "M" a considerably reduced thickness "d", which corresponds to at most about 50%, especially—as also shown here—25-30%, of the overall thickness "h" of hard and soft material.

The outsole comprises a plastics material having a modulus of elasticity as mentioned above. It can be manufactured in simple manner by injection-moulding. The tread layer of soft material is welded or bonded to the harder material on the tread side.

On the tread side, the outsole has two longitudinal guidance grooves 15 and a plurality of transverse grooves 16, those grooves being formed substantially only within the tread layer 14 of softer material. The base at least of the longitudinal grooves 15 in the region of the front sole portion is defined by the relatively hard material of the outsole. The longitudinal and transverse grooves are preferably so formed that their depths are approximately the same.

As can be seen very well in FIGS. 1 and 2, the transverse grooves 16, both in the front portion 12 and in the rear portion 11, are each curved in a backwards direction.

At the front end of the outsole there is formed a recess 17 which is open towards the tread side, within which recess 17 there is arranged a transverse pin 18 for articulated connection to a ski binding (not shown). The recess 17 is laterally bounded by two lands 19 of hard sole material. Alternatively, it may be bounded by the tread layer 14. In the latter case, it is advantageous for anchoring elements of metal connected to the transverse pin 18 to be integrated into the lateral boundaries of the recess 17.

From FIG. 3, it can also be seen that, whilst the predetermined overall thickness "h" is unchanging, the thickness "d" of the front portion 12 of the sole consisting of harder material continuously increases, starting from the metatarsophalangeal zone "M", both towards the rear and towards the front. As a result, a metaphalangeal bending zone "M" is defined by the dimensioning of hard and soft material.

The shoe heel 13 can be of conventional construction, especially as shown in FIG. 3; that is, the heel has material-reducing and weight-reducing recesses 20 on the side of the upper.

It should also be mentioned at this point that, as a result of the smooth, shallow dish-like formation of the front portion of the outsole 10, it is possible for the depth of the transverse grooves to be dimensioned so as to correspond to the depth of the longitudinal guidance grooves. The transverse grooves cannot be in collision with recesses on the upper's side of the outsole.

All features disclosed in the application documents are claimed as being important to the invention insofar as they are novel on their own or in combination compared with the prior art.

What is claimed is:

1. An outsole for a shoe the outsole comprising:

a rear portion comprising a shoe heel, an upper side, and a tread side; and a front portion comprising a metatarsophalangeal zone, an upper side and a tread side, said front portion being of slightly dish-shaped configuration, wherein both the upper side of the front portion and the tread side of the front portion are formed to be continuously smooth; and said outsole comprising a piece of harder material defining the overall shape and size of the outsole, the harder material selected from the group consisting of a relatively hard material and a relatively hard plastics material having a modulus of elasticity between 200 MPa and 250 GPa inclusive, the harder material being formed as a relatively thin sheet in a front region of the outsole defining a metatarsophalangeal bending region of the outsole, the harder material being formed in a concave dish shape in at least the front portion of the outsole such that the relatively thin sheet forming the front region bends upwards toward the edges of the harder material, the harder material having substantially smooth upper and lower surfaces;

a tread layer comprising a softer material selected from the group consisting of a relatively soft material and a rubber-like soft material welded or bonded only to portions of the lower surface of the piece of harder material, wherein the softer material, together with an associated portion of the harder material defines a predetermined overall sole thickness or sole height, and wherein the front portion of the outsole, whilst having an unchanging predetermined overall thickness, has, in at least the region of the metatarsophalangeal bending region, a thickness for the harder material which has been reduced to a percentage corresponding to at most about 50% of the overall thickness of the harder and the softer material.

2. The outsole according to claim 1, wherein on the tread side of the front portion there is formed at least one longitudinal guidance groove and, in at least the region of the metatarsophalangeal zone, one or more transverse grooves, said grooves being formed substantially only within the tread layer of the softer material.

3. The outsole according to claim 2, wherein each groove comprises a base, and wherein at least one of the bases of one of the grooves is defined by a portion selected from the group consisting of the harder portion of the front portion, and both the harder portion of the front portion and the harder portion rear portion.

4. The outsole according to claim 2, wherein the at least one longitudinal groove is of a depth that corresponds approximately to that of at least one transverse groove.

5. The outsole according to claim 4, wherein the at least one transverse groove is connected to the at least one longitudinal grooves.

6. The outsole according to claim 2, wherein at least one transverse groove in the front portion is in plan view curved in a backwards direction.

7. The outsole according to claim 1, wherein said outsole further comprises a front end, in which there is formed a recess which is open towards the tread side of the rear portion and the tread side of the front portion, within which there is arranged at least one transverse pin for articulating a connection to a ski binding.

8. The outsole according to claim 7, wherein said recess is laterally bound by a lateral binding means.

9. The outsole according to claim 7, further comprising anchoring elements connected to the transverse pin, wherein the anchoring elements are integrated into lateral boundaries of the recess.

10. The outsole according to claim 9, wherein said anchoring elements are of torsion-resistant material.

11. The outsole according to claim 1, wherein at least a portion of the upper side of the rear portion, the outsole is provided with material-reducing and weight-reducing recesses.

12. The outsole according to claim 11, wherein said material-reducing and weight-reducing recesses are provided in the region of the heel.

13. The outsole according to claim 1, wherein the percentage is about 30-35% of the overall thickness of the harder and the softer material.

* * * * *

UNITED STATES PATENT AND TRADEMARK OFFICE

CERTIFICATE OF CORRECTION

PATENT NO. : 7,591,085 B2
APPLICATION NO. : 11/034454
DATED : September 22, 2009
INVENTOR(S) : Bernt-Otto Haughlin It is certified that error appears in the above-identified patent and that said Letters Patent is hereby corrected as shown below:

On the title page under items (12) and (75), delete "Haugltn," and insert therefore, --Haughlin,--.

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,591,085 B2
APPLICATION NO. : 11/034454
DATED : September 22, 2009
INVENTOR(S) : Bernt-Otto Hauglin It is certified that error appears in the above-identified patent and that said Letters Patent is hereby corrected as shown below:

Title Page, Item 57, please delete "soft," and insert therefore, --soft--.

At Column 4, Line 66, after "harder portion" please insert --of the--.

At Column 5, Line 6, please delete "grooves." and insert therefore, --groove.--.

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,591,085 B2
APPLICATION NO. : 11/034454
DATED : September 22, 2009
INVENTOR(S) : Bernt-Otto Hauglin It is certified that error appears in the above-identified patent and that said Letters Patent is hereby corrected as shown below:

On the Title page, Item (75) Inventor, please delete "Haugltn" and insert therefore, --Hauglin,--.

Signed and Sealed this

Twenty-first Day of December, 2010

David J. Kappos

David J. Kappos
*Director of the United States Patent and Trademark Office*